US008366260B2

(12) United States Patent
Gauss et al.

(10) Patent No.: US 8,366,260 B2
(45) Date of Patent: Feb. 5, 2013

(54) PROCESS AND APPARATUS FOR THE PRINTING OF PANEL-SHAPED WORKPIECES

(75) Inventors: Achim Gauss, Dornstetten/Hallwangen (DE); Johannes Schmid, Starzach/Wachendorf (DE); Ludwig Albrecht, Dornstetten-Aach (DE); Karl Frey, Schopfloch (DE)

(73) Assignee: Homag Holzbearbeitungssysteme AG, Schopfloch (DE)

( * ) Notice: Subject to any disclaimer, the term of this patent is extended or adjusted under 35 U.S.C. 154(b) by 1236 days.

(21) Appl. No.: 11/632,461

(22) Filed: Jan. 10, 2007

(65) Prior Publication Data

US 2008/0239042 A1 Oct. 2, 2008

(30) Foreign Application Priority Data

Mar. 8, 2006 (EP) ..... 06004713

(51) Int. Cl.
*B41J 2/01* (2006.01)
*B41J 29/38* (2006.01)
*B41J 3/407* (2006.01)

(52) U.S. Cl. ..... 347/101; 347/5; 347/104; 347/106

(58) Field of Classification Search ..... 347/2, 5, 347/95, 101, 104, 106, 107
See application file for complete search history.

(56) References Cited

U.S. PATENT DOCUMENTS 3,811,915 A 5/1974 Burrell et al.
3,975,740 A 8/1976 Distler
4,017,869 A 4/1977 Meyer
4,215,350 A 7/1980 Mielke et al.
4,378,564 A 3/1983 Cross et al.
4,514,742 A 4/1985 Suga et al.
4,720,301 A 1/1988 Kito et al.
4,814,795 A 3/1989 Kuester et al.
5,113,757 A * 5/1992 Spencer ..... 101/35
5,133,822 A 7/1992 Fujii et al.
5,530,537 A * 6/1996 Thayer ..... 399/357
5,581,284 A 12/1996 Hermanson
5,810,487 A 9/1998 Kano et al.

(Continued)

FOREIGN PATENT DOCUMENTS

CA 2492712 12/2004
CN 1333720 1/2002

(Continued)

OTHER PUBLICATIONS

European Search Report issued in EP06004713.1 on Aug. 8, 2006.

(Continued)

*Primary Examiner* — Charlie Peng
*Assistant Examiner* — Hung Lam
(74) *Attorney, Agent, or Firm* — Baker Botts L.L.P.

(57) ABSTRACT

The invention discloses a process for printing of panel-shaped workpieces, in particular in the region of an edge, in which a section of a panel-shaped workpiece to be printed is subjected first of all to one or a plurality of pre-treatment stages which are selected from a) pre-cleaning, b) degreasing, c) improvement of the adhesion and wetting properties and d) reduction of the electrostatic charge, and in which the pre-treated section to be printed is subsequently printed with a desired pattern, in particular by means of inkjet printing. The invention also provides an apparatus for performing said process.

8 Claims, 1 Drawing Sheet

U.S. PATENT DOCUMENTS

| | | | | |
|---|---|---|---|---|
| 5,830,529 | A * | 11/1998 | Ross | 427/152 |
| 5,869,138 | A | 2/1999 | Nishibori | |
| 5,931,098 | A | 8/1999 | Bates | |
| 6,053,231 | A | 4/2000 | Matsuguchi | |
| 6,072,509 | A | 6/2000 | Wen et al. | |
| 6,174,052 | B1 | 1/2001 | Eremity et al. | |
| 6,286,920 | B1 | 9/2001 | Ridgway | |
| 6,358,220 | B1 | 3/2002 | Langen et al. | |
| 6,465,046 | B1 | 10/2002 | Hansson | |
| 6,634,729 | B1 * | 10/2003 | Schuman et al. | 347/2 |
| 6,635,142 | B1 | 10/2003 | Stula et al. | |
| 6,789,876 | B2 | 9/2004 | Barclay et al. | |
| 6,894,709 | B2 | 5/2005 | Pferrer | |
| 7,357,959 | B2 | 4/2008 | Bauer | |
| 7,691,294 | B2 * | 4/2010 | Chung et al. | 252/500 |
| 2001/0003871 | A1 | 6/2001 | Patton et al. | |
| 2001/0005942 | A1 | 7/2001 | Patton et al. | |
| 2001/0049010 | A1 | 12/2001 | Fenzi | |
| 2002/0024577 | A1 | 2/2002 | Takeya et al. | |
| 2002/0033851 | A1 | 3/2002 | Waldner et al. | |
| 2002/0033865 | A1 | 3/2002 | Ishinaga et al. | |
| 2002/0061389 | A1 | 5/2002 | Brooker et al. | |
| 2003/0020767 | A1 | 1/2003 | Saksa | |
| 2003/0029938 | A1 | 2/2003 | Vogel | |
| 2003/0043246 | A1 | 3/2003 | Codos | |
| 2003/0048343 | A1 | 3/2003 | Anderson | |
| 2003/0217807 | A1 | 11/2003 | Lesmann et al. | |
| 2003/0218650 | A1 | 11/2003 | Valero | |
| 2003/0218663 | A1 | 11/2003 | Baxter et al. | |
| 2004/0026017 | A1 | 2/2004 | Taylor et al. | |
| 2004/0028830 | A1 | 2/2004 | Bauer | |
| 2004/0094426 | A1 * | 5/2004 | Lai | 205/199 |
| 2004/0135867 | A1 * | 7/2004 | Schmitt et al. | 347/107 |
| 2004/0141764 | A1 | 7/2004 | Runkowske et al. | |
| 2004/0250947 | A1 | 12/2004 | Phillips et al. | |
| 2004/0257398 | A1 * | 12/2004 | Otsuki | 347/36 |
| 2004/0263544 | A1 | 12/2004 | Kojima | |
| 2005/0017995 | A1 | 1/2005 | Pferrer | |
| 2005/0034960 | A1 | 2/2005 | Shimamura et al. | |
| 2005/0151820 | A1 * | 7/2005 | Sirringhaus et al. | 347/107 |
| 2005/0204593 | A1 | 9/2005 | Bilger et al. | |
| 2005/0274272 | A1 | 12/2005 | Machesky | |
| 2005/0279450 | A1 | 12/2005 | King | |
| 2006/0021535 | A1 | 2/2006 | Kaiser | |
| 2006/0023018 | A1 | 2/2006 | Hatayama | |
| 2006/0046326 | A1 * | 3/2006 | Kok et al. | 438/21 |
| 2006/0228150 | A1 | 10/2006 | Hosokawa | |
| 2007/0064030 | A1 | 3/2007 | Abergel et al. | |
| 2007/0263043 | A1 | 11/2007 | Bradford et al. | |
| 2008/0092923 | A1 | 4/2008 | Elbing et al. | |
| 2008/0152819 | A1 | 6/2008 | Gauss et al. | |
| 2008/0277630 | A1 * | 11/2008 | Kiyoshima et al. | 252/514 |
| 2009/0252933 | A1 | 10/2009 | Free et al. | |
| 2010/0098887 | A1 | 4/2010 | Matsuishi et al. | |

FOREIGN PATENT DOCUMENTS

| | | |
|---|---|---|
| CN | 1438942 | 8/2003 |
| CN | 1681656 | 10/2005 |
| DE | 19532724 | 3/1997 |
| DE | 19823195 | 11/1999 |
| DE | 199 55 575 | 5/2001 |
| DE | 202004000662 U1 | 4/2004 |
| DE | 103 42 723 | 8/2005 |
| DE | 102005005638 | 2/2006 |
| DE | 202006000270 U | 4/2006 |
| DE | 10 2005 020119 B3 | 6/2006 |
| DE | 10 2006 056 010 | 7/2007 |
| EP | 0095046 | 11/1983 |
| EP | 0494363 | 7/1992 |
| EP | 0993903 | 4/2000 |
| EP | 1225053 | 7/2002 |
| EP | 1435296 | 7/2004 |
| EP | 1479524 | 11/2004 |
| EP | 1714884 | 10/2006 |
| EP | 1726443 | 11/2006 |
| EP | 1800813 | 6/2007 |
| FR | 2601265 | 1/1988 |
| GB | 722485 | 1/1955 |
| GB | 2335885 | 10/1999 |
| JP | 2006164 | 1/1990 |
| JP | 09226226 | 9/1997 |
| JP | 10 157245 | 6/1998 |
| JP | 10157245 | 6/1998 |
| JP | 10226045 | 8/1998 |
| WO | WO0148333 | 7/2001 |
| WO | WO2004016438 | 2/2004 |
| WO | WO2005009735 | 2/2005 |

OTHER PUBLICATIONS

International Search Report issued in PCT/EP06/04713 on Dec. 14, 2006.
Revised International Search Report issued in PCT/EP06/04713 on Mar. 13, 2008.
U.S. Appl. No. 11/765,196, filed Jun. 19, 2007.
U.S. Appl. No. 11/844,607, filed Aug. 24, 2007.
U.S. Appl. No. 11/935,924, filed Nov. 6, 2007.
U.S. Appl. No. 11/940,135, filed Nov. 14, 2007.
U.S. Appl. No. 12/055,904, filed Mar. 26, 2008.
U.S. Appl. No. 12/118,389, filed May 9, 2008.
U.S. Appl. No. 11/765,196, Apr. 1, 2010 Non-Final Office Action.
U.S. Appl. No. 11/765,196, Jul. 2, 2010 Response to Non-Final Office Action.
U.S. Appl. No. 11/940,135, Apr. 5, 2010 Non-Final Office Action.
U.S. Appl. No. 11/940,135, Aug. 5, 2010 Response to Non-Final Office Action.
U.S. Appl. No. 11/935,924, Feb. 23, 2010 Non-Final Office Action.
U.S. Appl. No. 11/935,924, May 24, 2010 Response to Non-Final Office Action.
U.S. Appl. No. 11/935,924, Jun. 28, 2010 Notice of Allowance & Examiner's Amendment.
U.S. Appl. No. 12/055,904, Apr. 2, 2010 Non-Final Office Action.
U.S. Appl. No. 12/055,904, Jul. 2, 2010 Response to Non-Final Office Action.
U.S. Appl. No. 11/844,607, Sep. 2, 2010 Non-Final Office Action.
U.S. Appl. No. 11/765,196, Sep. 22, 2010 Final Office Action.
U.S. Appl. No. 12/055,904, Sep. 30, 2010 Supplemental Response to Non-Final Office Action.
U.S. Appl. No. 11/940,135, Oct. 4, 2010 Final Office Action.
U.S. Appl. No. 11/960,121, filed Dec. 19, 2007.
U.S. Appl. No. 11/844,607, Dec. 2, 2010—Response to Non-Final Office Action.
U.S. Appl. No. 11/765,196, Dec. 16, 2010—Response to Final Office Action.
U.S. Appl. No. 12/055,904, Dec. 16, 2010—Final Office Action.
U.S. Appl. No. 11/940,135, Jan. 4, 2011—Response to Final Office Action.
U.S. Appl. No. 11/765/196, Jan. 18, 2011—Non-Final Office Action.
U.S. Appl. No. 11/940,135, Jan. 19, 2011—Advisory Action.
U.S. Appl. No. 11/844,607, Feb. 4, 2011—Final Office Action.
U.S. Appl. No. 11/960,121, Feb. 18, 2011—Non-Final Office Action.
U.S. Appl. No. 11/940,135, Mar. 4, 2011—Supplemental Response to Final Office Action.
U.S. Appl. No. 11/940,135, Mar. 21, 2011—Non-Final Office Action.
U.S. Appl. No. 12/055,904, Apr. 8, 2011—Non-Final Office Action.
U.S. Appl. No. 12/118,389, Nov. 3, 2011 Final Office Action.
U.S. Appl. No. 12/118,389, Aug. 23, 2011 Response to Non-Final Office Action.
U.S. Appl. No. 12/118,389, May 23, 2011—Non-Final Office Action.
U.S. Appl. No. 11/765,196, May 17, 2011 Response to Non-Final Office Action.
U.S. Appl. No. 11/765,196, Jun. 30, 2011 Final Office Action.
U.S. Appl. No. 11/844,607, May 4, 2011 Amendment and RCE.
U.S. Appl. No. 11/844,607, May 25, 2011 Notice of Allowance.
U.S. Appl. No. 11/844,607, Aug. 25, 2011 Issue Fee Payment.
U.S. Appl. No. 11/960,121, Jun. 15, 2011 Response to Non-Final Office Action.
U.S. Appl. No. 11/960,121, Aug. 19, 2011 Final Office Action.
U.S. Appl. No. 12/055,904, Dec. 16, 2010 Final Office Action.

U.S. Appl. No. 12/055,904, Mar. 15, 2011 Amendment and Request for Continued Examination (RCE).
U.S. Appl. No. 12/055,904, Apr. 8, 2011 Non-Final Office Action.
U.S. Appl. No. 12/055,904, Jul. 8, 2011 Response to Non-Final Office Action.
U.S. Appl. No. 12/055,904, Sep. 28, 2011 Notice of Allowance.
U.S. Appl. No. 11/632,461, Jun. 15, 2011 Final Office Action.
U.S. Appl. No. 11/844,607, May 4, 2011 Amendment and Request for Continued Examination (RCE).
U.S. Appl. No. 12/118,389, May 23, 2011 Non-Final Office Action.
U.S. Appl. No. 11/960,121, Nov. 21, 2011 Amendment and Request for Continued Examination (RCE).
Summary of ISO 2817 and 2813, International Organization for standard, (no date available).
"Numerical Investigation of Droplet Impact Spreading in Spray Coating of Paper", Advanced Coating Fundamentals Symposium, (Spring 2003).

* cited by examiner

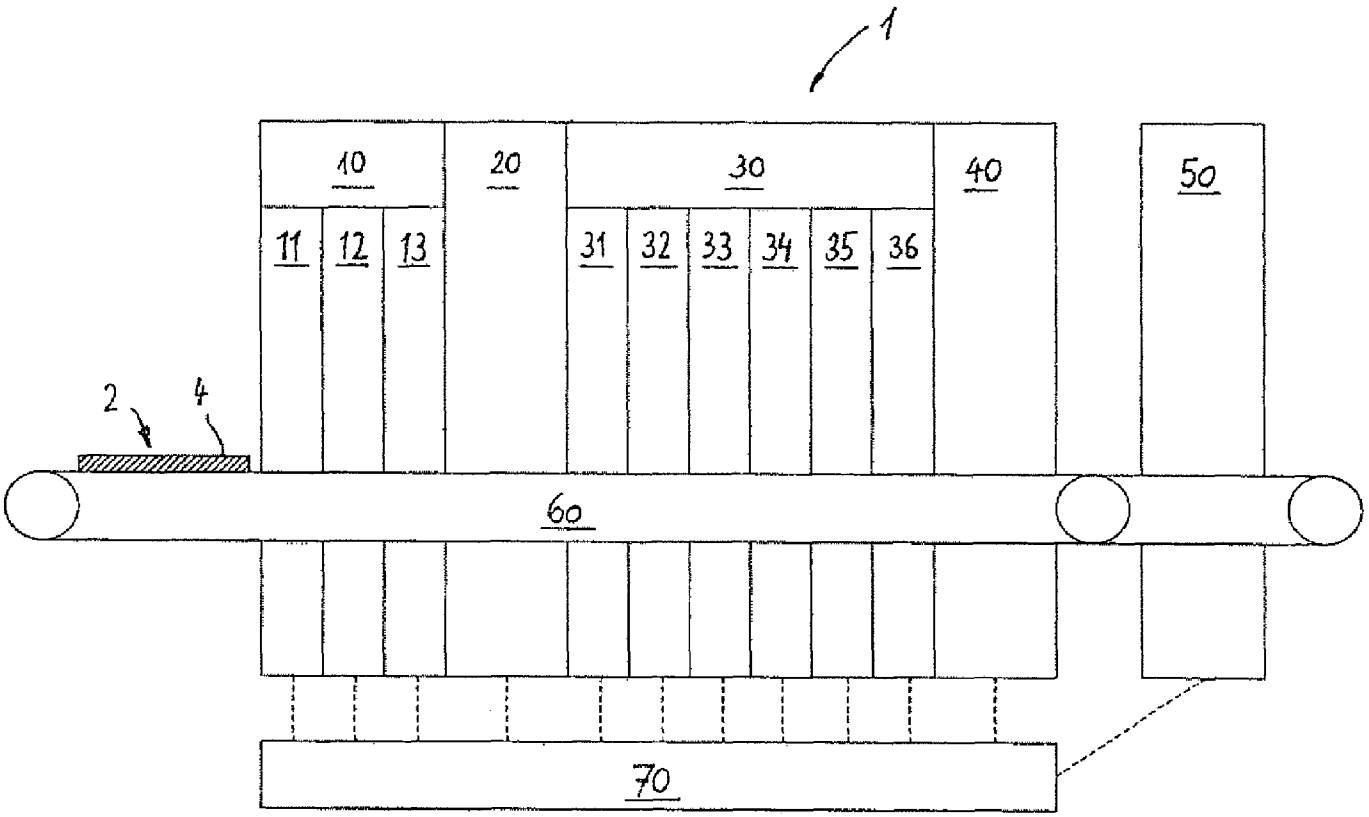
1
2
4
10
11
12
13
20
30
31
32
33
34
35
36
40
50
60
70

PROCESS AND APPARATUS FOR THE PRINTING OF PANEL-SHAPED WORKPIECES

CROSS-REFERENCE TO RELATED APPLICATIONS

This application claims priority to European patent application no. 06004713, filed Mar. 8, 2006, the disclosure of which is incorporated herein by reference in its entirety.

FIELD OF THE INVENTION

The present invention relates to a process and an apparatus for the printing of panel-shaped workpieces in which a section of the panel-shaped workpiece is printed with a desired pattern, in particular by means of inkjet printing.

PRIOR ART

After being cut to length and having passed through the sizing or shaping process, panel-shaped workpieces, which are used, for example, as construction elements for furniture, are often provided on a narrow side with suitable materials such as edges, webs or foils made from technical polymers (ABS, PP, PVC) or wood veneer strips. This measure serves, for example, to achieve a deliberate appearance or haptic or to act as protection against mechanical stress or to prevent ingress of moisture.

The panel-shaped workpieces considered here may be chipboard panels, plywood panels, fiberboard panels and other wooden material boards or, for example, gypsum plasterboard and gypsum fiber board or, for example, laminated panels and rigid foam panels or wood wool composite panels or composite boards. The narrow sides of panel-shaped workpieces considered here are the narrow sides of panel-shaped workpieces sealed with an appropriate material for the purpose, executed for example as plastic web, section or foil or as wooden strips or veneers or other natural materials or as a surface sealed with lacquer, UV varnish or sealing medium.

A process and an apparatus for printing of such panel-shaped workpieces by means of inkjet printing is disclosed, for example, in DE 100 31 030 A1. However, it appears that the known printing process and the known printing apparatus lead to a limited quality and durability of the printed image applied.

PRESENTATION OF THE INVENTION

The object of the present invention is, therefore, to provide a process and an apparatus for printing of panel-shaped workpieces, in particular by means of inkjet printing, which facilitates enhanced quality and durability of the printed image applied to the panel-shaped workpiece.

This object is achieved according to the invention as described in the independent claims. Particularly advantageous developments of the invention are stated in the dependent claims.

The invention is based on the knowledge that, in panel-shaped workpieces of the type under discussion here, the machining process for sealing the narrow side or other sections of surface leads to a distinctive level of contamination on the surface which impairs the quality and durability of the printed image subsequently applied. Usually, dust particles, lubricants, adhesive residues, splinters, sweat from hands, finger marks, scratches and other types of dirt or damage are applied to the surface during and as a result of the manufacturing process when sealing the panel-shaped workpieces. In addition, the technical polymers which are used here, for example, are water-resistant in their surface properties and can thus only be wetted with difficulty.

Against this background, it is provided in the process according to the invention that a section of a panel-shaped workpiece to be printed is subjected first of all to one or more pre-treatment stages which are selected from a) pre-cleaning, b) degreasing, c) improvement of the adhesion and wetting properties and d) reduction of the electrostatic charge. It is possible in this manner, using the process according to the invention, to create printed images with outstanding quality on the panel-shaped workpieces, said images having excellent adhesion on the printed section and thus having very good durability.

In this regard, according to a development of the present invention, it is provided that the pre-treatment stages are chosen selectively depending on the material and/or the surface condition of the section to be printed. As a result, it is not always necessary to perform all the pre-treatment stages referred to since it may be sufficient to perform just one or some pre-treatment stages matched to the material or the surface condition in each case without having to make sacrifices in terms of the quality or durability of the printed image obtained. Although this selection may be made manually, by an operator for example, it is preferable within the scope of the invention for the selective choice to be controlled electronically, by means of an appropriate control device for example.

In principle, the process according to the invention may be carried out on a workpiece disposed in a stationary position, in a processing centre for example, which is equipped to perform the various pre-treatment stages. With respect to a speedy process sequence with high throughput, however, it is provided according to a development of the invention that the pre-treatment stages and/or printing will be performed in through-feed operation.

The relevant pre-treatment stages may be performed in the most varied manner within the scope of the present invention, whereby particularly advantageous developments of these pre-treatment stages are the subject-matter of dependent claims 3 to 6.

An apparatus according to the invention for performing the process according to the invention is characterized in that it has one or more pre-treatment modules which are selected from a pre-cleaning module, a degreasing module, a module for improving the adhesion and wetting properties and a module for reducing the electrostatic charge. As a result of this it is possible to achieve, as in the process according to the invention, a printed image on the panel-shaped workpiece which has excellent quality and a high level of durability.

According to a development of the apparatus according to the invention, it is provided that the pre-treatment modules may be operated selectively depending on the material and/or the surface condition of the section to be printed. This renders it possible to match operation of the apparatus according to the invention selectively to the material and/or the surface condition of the section to be printed so that the outcome is an optimum pre-cleaning result for each panel-shaped workpiece and thus also an optimum printed image.

According to a development of the invention, the pre-treatment modules and preferably also the printing device and/or the handling device are provided in conjunction with a control device. This renders it possible for the apparatus according to the invention to be fully automated and thus to work quickly and efficiently without having to make sacrifices in terms of the quality or durability of the printed image obtained.

The apparatus according to the invention may, for example, be what is known as a stationary machine (a processing center for example) or what is known as a through-feed machine. In the former case, the workpieces to be printed are stationary and the handling device moves the relevant pre-treatment modules or the printing device in relation to the workpieces to be printed. In the latter case, the pre-treatment modules and the printing device are stationary and the workpieces to be printed are moved past these pre-treatment modules or the printing device by means of the handling device. Within the scope of the present invention, however, combinations of both concepts are also possible, for example pre-treatment modules working in through-feed operation and a printing device working as a stationary machine. Particularly fast and efficient operation of the apparatus may, however, be achieved if the handling device is a through-feed handling device according to a development of the present invention, which transports the panel-shaped workpieces to be printed past or through the pre-treatment modules and/or the printing device.

Furthermore, the apparatus according to the invention may be constructed of a plurality of different or separate machine units, for example by providing a separate machine unit in each case for each pre-treatment module and for the printing device, whereby these units may also be spatially separate. According to a development of the present invention, however, it is preferable for a plurality, preferably all, of the pre-treatment modules to be provided in one machine layout since this simplifies operation of the apparatus according to the invention and improves the pre-cleaning result. Moreover, it is particularly preferable that the printing device and/or the handling device, if necessary, are also provided in this machine layout.

BRIEF DESCRIPTION OF THE FIGURE

The FIGURE shows a schematic lateral view of a preferred embodiment of the apparatus according to the invention.

DETAILED DESCRIPTION OF PREFERRED EMBODIMENTS

Preferred embodiments of the present invention will be described in detail in the following with reference to the accompanying FIGURE.

The FIGURE shows a schematic lateral view of a pre-treatment and printing apparatus 1 as a preferred embodiment of the present invention. Apparatus 1 serves for the printing of panel-shaped workpieces 2, which are made at least in part of wood, wood materials, wood replacement materials, plastics, lightweight construction materials or the like, such as are frequently used, for example, in furniture manufacture.

As can be seen in the FIGURE, apparatus 1 in the present embodiment comprises a plurality of pre-treatment modules 10, 20, 30, 40 or submodules, which will be addressed in greater detail below. The present invention is not, however, restricted to the layout shown. In fact, an apparatus according to the invention may also have only one or a plurality of pre-treatment modules, for example if the apparatus is only designed for a specific type of panel-shaped workpieces to be printed. The order of the individual pre-treatment modules or submodules is also not restricted to the layout shown in FIG. 1, although in this case the disposal shown is a preferred layout or sequence.

In addition, apparatus 1 comprises a printing device 50, which in this case in particular is preferably an inkjet printing device. An inkjet printing device is understood to be an ink printing device in which ink droplets are ejected according to the drop-on-demand process, i.e. the printing device ejects a desired sequence of ink droplets in response to a print command. Print heads, which have piezoelectric elements or which work thermally (bubble jet), are frequently used in such printing devices. It should, however, be noted that other appropriate printing devices, such as laser printing devices, thermal printing devices or the like, may also be used within the scope of the present invention.

The apparatus according to the invention additionally comprises a handling device 60, which in the present embodiment is designed as a linear conveyor, for example a chain or belt conveyor. Panel-shaped workpieces 2 may be transported past or through pre-treatment modules 10, 20, 30, 40 and the corresponding submodules and printing device 50 on this handling device 60. In this regard, a section 4 of panel-shaped workpiece 2 to be printed and pre-treated faces pre-treatment modules 10, 20, 30, 40 or printing device 50, i.e. section 4 is disposed in FIG. 1 on the side facing away from the observer.

Pre-treatment modules 10, 20, 30, 40 and their submodules will now be explained in greater detail in accordance with the present embodiment.

Apparatus 1 comprises first of all a pre-cleaning module 10, which in the present embodiment has three submodules, that is to say a brushing module 11, a grinding module 12 and a $CO_2$-snow blast cleaning module 13. The brushing module may function mechanico-chemically in that it has, for example, filament fiber brushes coated with diamond dust to which an anti-static and cleaning agent is added during operation. In this case, brushing simultaneously achieves a grinding, cleaning and anti-static treatment. This brushing module 11 is particularly well suited to hard surfaces or to surfaces where an increase in roughness is desired. These include, for example, wood veneers or lacquered surfaces. A further cleaning device (brush for example) may be provided downstream of brushing module 11 and grinding module 12 to ensure that abraded dirt is removed, although this is not shown in the FIGURE.

Cleaning of the surface by means of $CO_2$-snow blast cleaning module 13 is advisable in particular if greases, oils or other organic substances are to be found on surface 4 to be printed. Cleaning using $CO_2$-snow blasting is based on a plurality of physical and chemical effects whereby their thermal, chemical and mechanical action is utilized. The process converts liquid $CO_2$, which is provided, for example, in $CO_2$ cylinders, into compressed, solid $CO_2$ snow particles by means of thermodynamic and physical processes. These $CO_2$ snow particles are produced in a specific size with the help of an appropriate process and nozzle technology. At the same time, they are added to a compressed air flow in a multi-stage mixing chamber with the aid of a jet nozzle. In this regard, a homogenous free jet is generated with which surfaces may be cleaned and pre-treated.

The thermal effect of $CO_2$-snow blasting brings about shock freezing of the surface contamination. The use of $CO_2$-snow blasting leads to embrittlement of the contamination due to the difference between the coefficients of thermal expansion of the contamination and the surface. As a result it is easily removed from the surface. In addition, the use of compressed air as a transport gas and the design of the blasting nozzle lead to mechanical impacts which remove the embrittled contaminations from the surface. The sublimation expansion of the $CO_2$ also contributes to this which contributes to detachment and removal of the contamination from the surface. The chemical effect of $CO_2$-snow blasting also consists of processes, which detach the contamination from the surface, that are brought about by the carbon dioxide which becomes gaseous following the sublimation process. This has a further positive effect on detachment of the surface contaminations and assists with removal of the contamination.

$CO_2$-snow blasting modules and devices are available, for example, from Cryosnow GmbH, Zitadellenweg 20 E, D-13599 Berlin under the designation CS-4.

With $CO_2$-snow blasting it is also no problem to remove the loosened contaminations and the process gas by means of an appropriate extraction system (not shown in the FIGURE). Overall, $CO_2$-snow blasting has the advantage of bringing about non-contact and thus non-abrasive cleaning. Thus $CO_2$-snow blasting is particularly suitable for plastic-based surfaces for example. In addition, $CO_2$-snow blasting is particularly well-suited to surfaces contaminated with greases, oils or other organic substances as it is possible to extract these contaminations, which shock freeze and become brittle due to the low temperatures of the $CO_2$, and remove them by means of an extraction system (not shown).

As can be seen in the FIGURE, apparatus 1 also comprises a degreasing module 20. Degreasing module 20 is represented in the present embodiment by an electro-mechanical wiper module which is set up to apply a degreasing agent to the section to be printed 4 and to wipe it off. Acetone, methyl ethyl ketone (MEK), isopropanol, ethanol or the like, for example, may be used as cleaning and degreasing agents. Attention must be paid to compatibility with the surface to be degreased when selecting the agent; the agent used should not attack the surface. The wiper module comprises a wiping means, for example in the form of a suitable non-woven fabric, cloth or other medium which soaks up liquids, which is appropriately moistened by means of a spray nozzle. The wiping means is capable of being brought into direct contact with surface 4 in order to bring about the mechanico-chemical degreasing process.

The use of degreasing module 20 and its wiper module is particularly suitable, for example, for plastic-based surfaces such as plastic edges or plastic foils.

Apparatus 1 also comprises a module 30 for improvement of the adhesion and wetting properties, which in the present embodiment has a plurality of submodules, that is to say a grinding and roughening module 31, a priming module 32, a corona treatment module 33, a plasma treatment module 34, a flame treatment module 35 and an adhesion promotion module 36.

Grinding and roughening module 31 is designed as a conventional mechanical grinding apparatus which has, for example, a circular or rectangular grinding means or a grinding means designed as a belt product. This grinding apparatus may be disposed, together with a downstream cleaning unit (not shown), under an extractor hood (not shown) to pick up and discharge the contamination occurring during grinding.

Grinding and roughening is preferably used, for example, on narrow sides to which natural materials such as wood veneer or cork are bonded or which have been provided with lacquers, UV varnishes, paints or sealing agents. Roughening of such surfaces facilitates enhanced meshing with additional layers to be applied on top.

Priming module 32 may, for example, have a spray or roller application device, in order, for example, to apply a solvent- or water-based primer, which contains, for example, pore filler as the chemically active component. Such pore filler is taken up by the surface by means of adsorption and reduces the surface's absorbency which may be expedient, in particular in natural materials. In addition, the pore filler forms a sealed film after drying for accepting further finishing layers such as printing dyes or inks. Such priming is preferably carried out, for example, on natural materials such as wood strips, wood veneer or other natural materials such as cork or the like. In this regard, the primer should be matched to the natural materials, i.e. be chemically compatible, in order to achieve the best possible adhesion and wetting properties.

Apparatus 1 preferably has a corona treatment module 33, a plasma treatment module 34 and a flame treatment module 35, which will be described subsequently, in order to facilitate improvement of the adhesion of layers such as printing dyes or inks to be applied to polymers or similar surfaces 4.

Corona treatment module 33 is set up to generate a high voltage discharge to surface 4. The high-voltage or corona discharge generates an electron avalanche towards surface 4 by means of flow filaments. In this case surface 4 represents a lower voltage potential and a high-voltage discharge takes place via the surrounding atmosphere. The electrons generated in the discharge hit surface 4 with such high energy that the molecular bonds of the surfaces (in polymers) are split. A corresponding corona treatment is available, for example, from Tigres Dr. Gerstenberg GmbH, Mühlenstr. 12, D-25462 Rellingen.

Plasma treatment module 34 is set up to generate a plasma spatially separated from a high-voltage discharge and to blow this plasma onto surface 4 by means of compressed air. A corresponding plasma treatment module 34 is available, for example from Tigres Dr. Gerstenberg GmbH, Mühlenstr. 12, D-25462 Rellingen.

Flame treatment module 35 is set up to bring about the formation of chemically functional groups such as oxygen and hydroxyl radicals which act on a surface located within a flame. Propane/butane gas mixtures are used as the combustion gas whereby the gas flame is adjusted such that an excess of oxygen occurs. In this regard surface 4 is heated for a short time without melting it. In addition, lightly bonded combustible layers sitting on the surface are burnt and the base material is oxidized. As a result, the oxygen atoms incorporated in the polymer structures increase the surface energy and thus the wettability of the (plastic) surface. A corresponding flame treatment module is available, for example, from Arcotec GmbH, Rotweg 24, D-71297 Mönsheim.

Common to all three submodules 33, 34, 35 described is that they bring about incorporation of oxygen atoms in the topmost surface layers. Furthermore, any lightly bonded extraneous layers possibly present on the surface are removed by means of these submodules. In this regard, the properties of the surface in respect of appearance, consistency and geometry are only altered to a small extent which is not detectable to the naked eye. Associated with this is an increase in the physical surface energy to the values advantageous for further finishing. In this case, the level of surface energy is directly proportional to the oxygen concentration in the plastic surface. The result is an improvement in the chemical bond between the plastic molecules and the other finishing layers to be applied, for example the printing dye or ink.

Corona treatment module 33 and plasma treatment module 34 have the advantage that they only heat surface 4 a little which prevents a deformation or even ignition of the plastics. In flame treatment module 35, the gap between the flame and surface 4 should be adjusted appropriately in order to prevent excessive heating of surface 4. In addition, flame treatment module 35 must be switched off when handling device 60 stops so as to rule out damage to surface 4.

Devices which provide what are known as cold, open, atmospheric plasmas have proven their value in respect of corona treatment module 33 and plasma treatment module 34.

In this case, the actual plasma (gas) is spatially separated from the flow filaments between the electrodes. In addition, normal ambient air is used as the surrounding gas. Thus it is possible to dispense with a particular atmosphere (vacuum or process gas).

Apparatus 1 according to the invention in the present embodiment also comprises an adhesion promotion module 36. Adhesion promotion module 36 is set up, for example, to apply a primer or a UV primer to surface 4, which will frequently be performed as an alternative to physical pre-treatment by corona, plasma and flame treatment modules 33, 34, 35 described above.

The aim of applying adhesion promoters is likewise to enhance the wetting and adhesion properties of surface 4. Adhesion promotion module 36 may, for example, have spray or roller application equipment and, if necessary, an appropriate drying device (hot air fan for example), which is connected downstream of the application equipment. In the case of a UV primer, adhesion promotion module 36 may also, if necessary, have a UV light source with appropriate emitter.

The primer may, for example, be a solvent-containing primer, which contains a chemically active component dissolved in the solvent. This chemically active component should be matched in each case to the plastic surface and to the finishing layer simultaneously. The chemically active component remains on the surface after evaporation of the solvent. The primer then forms a chemical bridge between the surface and a subsequent finishing layer thus creating chemical compatibility between both materials.

On the other hand, for example, what is known as a UV primer may be used as has already been mentioned above. This usually does not contain any solvent and curing takes place rather by irradiation with UV light of an appropriate wavelength. In this case, polymerization of unsaturated monomers located in the liquid primer is activated by means of photo-initiators (radicals) sensitive to UV light. When the chain reaction has finished (completion of polymerization), the UV primer's carrier material remains as another additional plastic layer on the (plastic) surface lying beneath it in which (plastic) surface the chemically active component is embedded and which here provides a chemical bridge to further finishing layers in the same manner.

Apparatus 1 according to the invention also comprises a module 40 for reducing the electrostatic charge. Some of the pre-treatment modules 10, 20, 30 and their submodules which are connected upstream of module 40, have by their nature the characteristic of causing an electrostatic charge of surface 4 of panel-shaped workpiece 2. This is primarily the case in materials which have a lower electrical surface conductivity such as, for example, plastics or lacquered surfaces. In order to reduce the electrostatic charge in these surfaces, module 40 may, for example, have an ionizing device, which may, for example, be rod-shaped, to reduce the electrostatic charge. The electrostatic charge of surface 4 may be brought to values which are no longer critical for subsequent printing by means of this rod-shaped ionizing device.

As can also be seen in the FIGURE, apparatus 1 according to the invention in the present embodiment also comprises a control device 70 which is represented, for example, by an appropriate control computer or similar. Control device 70 is connected, as shown by dotted lines in the FIGURE, to pre-treatment modules 10, 20, 30, 40 and their submodules and also additionally to printing device 50. Although not shown in the FIGURE, control device 70 may also be appropriately connected to handling device 60. In this manner, operation of individual pre-treatment modules 10, 20, 30, 40 and their submodules may be selectively and individually controlled by the control device. In this regard, it is preferable for control device 70 to be supplied with information by way of the material and/or the surface condition of sections 4 to be printed in each case so that pre-treatment modules 10, 20, 30, 40 and their submodules can be operated selectively depending on these or other suitable parameters of the section to be printed or even depending on other parameters.

Pre-treatment modules 10, 20, 30, 40 and their submodules are represented in the FIGURE in such a manner that they are provided on a common machine layout (not shown in detail). Although the printing device is represented at a distance from these components in the FIGURE, the printing device may also be provided on the same machine layout, as may handling device 60 and control device 70 also. As already referred to initially, the present invention does, however, also comprise apparatuses in which individual pre-treatment modules 10, 20, 30, 40 and their submodules and the remaining components of the apparatus are provided on separate machine layouts or are even disposed so as to be spatially separate (for example in different halls or even different sites).

Operation of the apparatus according to the invention takes place, for example, as follows. First of all, information about the type, number, condition, etc. of panel-shaped workpieces 2 to be printed is routed to control device 70. This information may be specified externally or may, if necessary, be detected and passed onto control device 70 by sensors, measuring devices or the like, not shown in greater detail here, which are disposed upstream of the apparatus.

Based on this information, control device 70 controls handling device 60 such that panel-shaped workpieces 2 are transported along handling device 60 whereby surface 4 of relevant panel-shaped workpieces 2 to be printed faces towards pre-treatment modules 10, 20, 30, 40 and their submodules and subsequently towards printing device 50. During the through-feed of each panel-shaped workpiece 2, the control device controls the individual pre-treatment modules and the printing device such that, depending on the material and/or the surface condition of section 4 to be printed or, if necessary, on other parameters, at least one or a plurality of pre-treatment modules are operated in each case in order to carry out the appropriate pre-treatment on section 4 to be printed, before said section is subsequently printed with a desired pattern by printing device 50.

The selection criteria for individual pre-treatment modules 10, 20, 30, 40 and their submodules are not particularly restricted within the scope of the present invention although basic approaches for an advantageous selection of the individual modules have been given in the description above.

The invention claimed is:

1. A process for printing panel-shaped workpieces, comprising:

(a) pre-treating a section of a panel-shaped workpiece to be printed with at least two pre-treatment stages automatically selected from a group consisting of pre-cleaning, degreasing, improving of the adhesion and wetting properties, and reducing of an electrostatic charge, wherein the automatic selection of the at least two pre-treatment stages is controlled electronically and is based on a factor selected from a group consisting of a material type and a surface condition of the section to be printed, and combinations thereof, and (b) printing the pre-treated section with a desired pattern, wherein the factor is detected by an electronic sensor disposed upstream of the pre-treatment stages.

2. The process according to claim 1, wherein the at least two pre-treatment stages are carried out in a through-feed operation.

3. The process according to claim 1, wherein the pre-cleaning stage comprises a partial stage which is selected from the group consisting of brushing, grinding, and cleaning by means of $CO_2$-snow blasting, and combinations thereof.

4. The process according to claim 1, wherein the degreasing stage comprises electro-mechanical wiping of the section to be printed with a degreasing agent.

5. The process according to claim 1, wherein the improving the adhesion and wetting properties stage comprises a partial stage which is selected from a group consisting of grinding and roughening, priming, corona treatment, plasma treatment, flame treatment, and application of adhesion promoters, and combinations thereof.

6. The process according to claim 1, wherein the reducing the electrostatic charge stage is carried out as a final pre-treatment stage.

7. The process according to claim 1, wherein the printing is carried out in a through-feed operation.

8. A process for printing panel-shaped workpieces, comprising:

(a) pre-treating a section of a panel-shaped workpiece to be printed with at least two pre-treatment stages; and (b) printing the pre-treated section with a desired pattern, wherein:

the at least two pre-treatment stages are automatically selected based on a factor selected from a group consisting of a material type and a surface condition of the section to be printed, and combinations thereof;

the automatic selection is controlled electronically;

the at least two pre-treatment stages comprise at least two of pre-cleaning, degreasing, improving of the adhesion and wetting properties, and reducing of an electrostatic charge; and the factor is detected by an electronic sensor disposed upstream of the at least two pre-treatment stages.

* * * * *